US012704077B2

(12) United States Patent
Shimo

(10) Patent No.: US 12,704,077 B2
(45) Date of Patent: Aug. 11, 2026

(54) ANTI-ICE/DE-ICE SYSTEM

(71) Applicant: HONEYWELL INTERNATIONAL INC., Charlotte, NC (US)

(72) Inventor: Masayoshi Shimo, Phoenix, AZ (US)

(73) Assignee: HONEYWELL AEROSPACE US LLC, Phoenix, AZ (US)

( * ) Notice: Subject to any disclaimer, the term of this patent is extended or adjusted under 35 U.S.C. 154(b) by 137 days.

(21) Appl. No.: 18/906,887

(22) Filed: Oct. 4, 2024

(65) Prior Publication Data

US 2026/0097853 A1 Apr. 9, 2026

(51) Int. Cl.
*B64D 15/04* (2006.01)
*F01D 25/02* (2006.01)

(52) U.S. Cl.
CPC ..... *F01D 25/02* (2013.01)

(58) Field of Classification Search
CPC ..... B64D 15/04; B64D 15/02
See application file for complete search history.

(56) References Cited

U.S. PATENT DOCUMENTS 6,698,691 B2 3/2004 Porte
8,602,360 B2 12/2013 Porte et al.
10,221,765 B2 3/2019 Alstad et al.
10,486,821 B2 11/2019 Mackin et al.
2002/0139899 A1 10/2002 Porte
2017/0298760 A1 10/2017 Vallino
2018/0216529 A1 8/2018 Maalioune et al.
2024/0254894 A1 8/2024 Mallampati

FOREIGN PATENT DOCUMENTS

EP 0913326 A2 5/1999
EP 4206449 A1 7/2023

OTHER PUBLICATIONS

NASA, "An Experimental Investigation of Fluid Flow and Heating in Various Resonance Tube Modes," Technical Memorandum 33-780, Jet Propulsion Laboratory, Sep. 1, 1976.

*Primary Examiner* — Timothy D Collins
*Assistant Examiner* — Terri L Filosi
(74) *Attorney, Agent, or Firm* — Ingrassia, Fisher & Lorenz LLP

(57) ABSTRACT

An anti-ice/de-ice system includes a component having at least one flow channel extending therethrough, a pressurized air source, and an aerodynamic resonator. The pressurized air source is configured to supply a flow of pressurized air at a first temperature. The aerodynamic resonator includes an inlet nozzle, a resonance tube, and an outlet port. The aerodynamic resonator is coupled to receive, via the inlet nozzle, the flow of pressurized air at the first temperature and configured to discharge, via the outlet port, the flow of pressurized air at a second temperature into the at least one flow channel of the component, wherein the second temperature is greater than the first temperature.

20 Claims, 6 Drawing Sheets

ANTI-ICE/DE-ICE SYSTEM

TECHNICAL FIELD

The present disclosure relates to an anti-ice/de-ice system and, more particularly, to an aircraft anti-ice/de-ice system.

BACKGROUND

An aircraft may be exposed to numerous and varied environmental conditions. For example, the aircraft may be exposed to various environmental conditions that may result in ice accretion on various components, including, for example, the aircraft control surfaces and various portions of the gas turbine propulsion engines, such as the inlet portion of engine nacelle and/or the static vanes within the compressor section of the propulsion engines.

With regard to the static vanes within the compressor section, ice accretion may occur when there is high concentration of water in the air when the outside temperature is below freezing. This can occur when the aircraft is descending from high altitude. During the descent, water in the air condenses, due to low static temperature at certain operating conditions, forming ice crystals on the surface of the static blades. To alleviate this, some engines have incorporated electrical heating pads on the blade surfaces to prevent ice crystal formation. This solution, however, can increase manufacturing costs due, at least in part, to the complexity of including heating pads on the blade structure. This solution additionally relies on supplemental electrical power, which may not always be available.

Hence, there is a need for a method of preventing ice accretion on at least the static vanes within the compressor section of the propulsion engines (and various other components, as needed) that does not rely on complex manufacturing processes and remains available when additional electrical power may not be available. The present disclosure addresses at least these needs.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, an anti-ice/de-ice system includes a component having at least one flow channel extending therethrough, a pressurized air source, and an aerodynamic resonator. The pressurized air source is configured to supply a flow of pressurized air at a first temperature. The aerodynamic resonator includes an inlet nozzle, a resonance tube, and an outlet port. The aerodynamic resonator is coupled to receive, via the inlet nozzle, the flow of pressurized air at the first temperature and configured to discharge, via the outlet port, the flow of pressurized air at a second temperature into the at least one flow channel of the component, wherein the second temperature is greater than the first temperature.

In another embodiment, an aircraft anti-ice/de-ice system includes an aircraft component having at least one flow channel extending therethrough, a pressurized air source, and an aerodynamic resonator. The pressurized air source is disposed on or within the aircraft and is configured to supply a flow of pressurized air at a first temperature. The aerodynamic resonator is disposed on or within the aircraft and includes an inlet nozzle, a resonance tube, and an outlet port.

The aerodynamic resonator is coupled to receive, via the inlet nozzle, the flow of pressurized air at the first temperature and configured to discharge, via the outlet port, the flow of pressurized air at a second temperature into the at least one flow channel of the component, wherein the second temperature is greater than the first temperature.

In yet another embodiment, an anti-ice/de-ice system includes a component, a pressurized air source, and a plurality of aerodynamic resonators. The component includes a pressurized air inlet, a pressurized air outlet, and has a plurality of cavities formed therein. Each cavity has at least a cavity inlet port and a cavity outlet port. The pressurized air source is configured to supply a flow of pressurized air at a first temperature to each of the cavities via the pressurized air inlet. The aerodynamic resonators are formed integrally with the component. Each aerodynamic resonator is associated with a different one of the plurality of cavities and includes an inlet nozzle, a resonance tube, and an outlet port. Each inlet nozzle is in fluid communication with the cavity outlet port of its associated cavity, and each outlet port is in fluid communication with the pressurized air outlet. Each aerodynamic resonator is coupled to receive, via its inlet nozzle, the flow of pressurized air at the first temperature from its associated cavity outlet port and is configured to discharge, via the outlet port, the flow of pressurized air at a second temperature out the pressurized air outlet, wherein the second temperature is greater than the first temperature.

Furthermore, other desirable features and characteristics of the anti-ice/de-ice system will become apparent from the subsequent detailed description and the appended claims, taken in conjunction with the accompanying drawings and the preceding background.

BRIEF DESCRIPTION OF DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
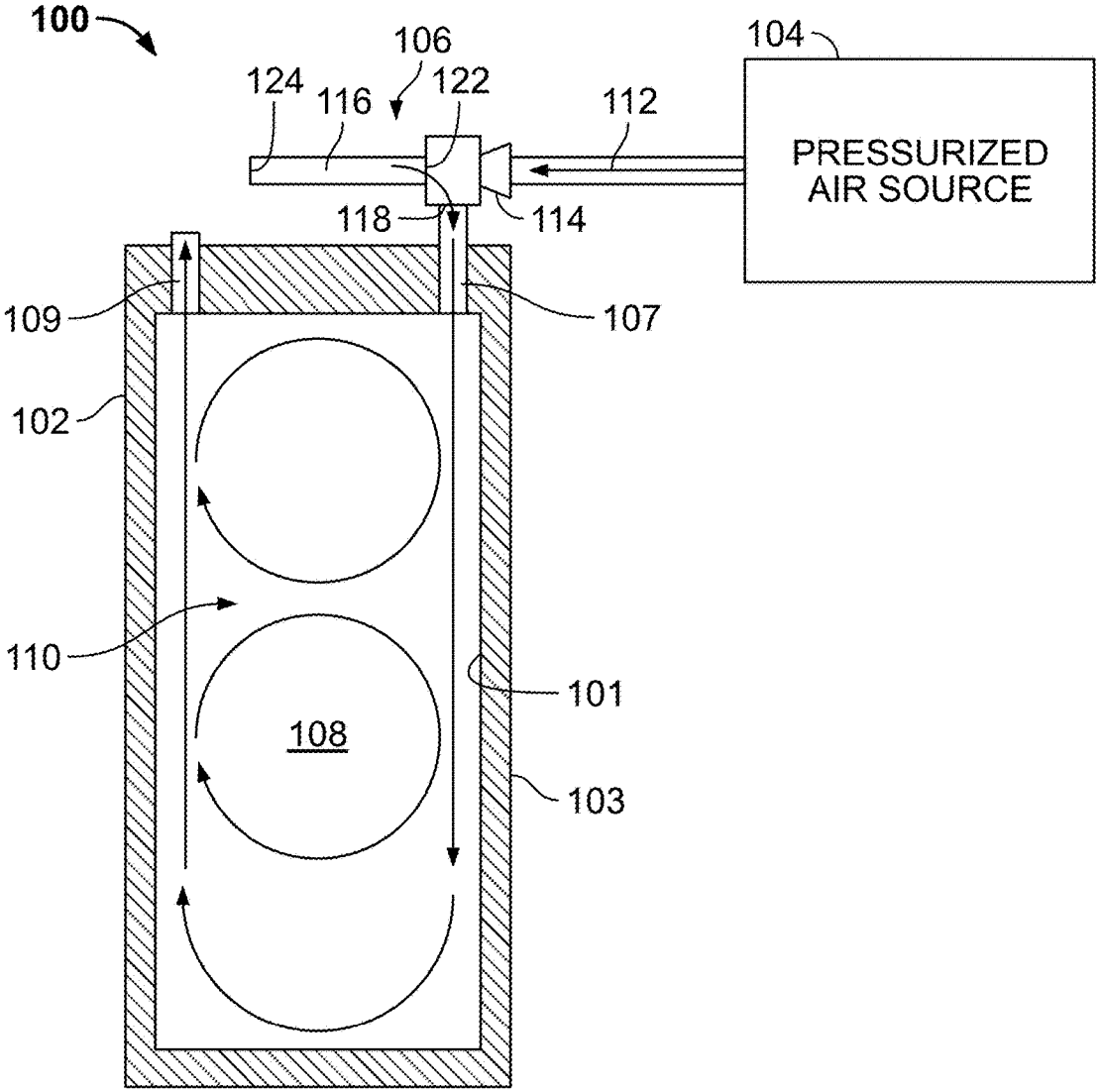
FIG. 1 depicts a simplified schematic representation of one example embodiment of an anti-ice/de-ice system.

Referring to FIG. 1, a simplified schematic representation of one embodiment of an anti-ice/de-ice system 100 is depicted. In the depicted embodiment, the system 100 includes at least one component 102, a pressurized air source 104, and an aerodynamic resonator 106. The component 102, which may be any one of numerous types of components that is susceptible to ice accretion, has at least one flow channel 108 that extends through the component 102 between a flow channel inlet 107 and a flow channel outlet 109. More specifically, it is seen that, at least in the depicted embodiment, the component 102 includes an inner surface 101 and an outer surface 103, and the inner surface 101 and the at least one flow channel 108 together define an internal flow volume 110. Although only one component 102 is depicted in FIG. 1, the system 100 could include more than one component. Some non-limiting examples of specific implementations of the component 102 include a static compressor blade, an inlet portion of a gas turbine engine nacelle, and at least one aircraft control surface.

No matter how the component 102 is specifically implemented, the pressurized air source 104 is configured to supply a flow of pressurized air 112 at a first temperature. It will be appreciated that the pressurized air source 104 may also be variously implemented. In one specific embodiment, which is depicted in FIG. 2, the system 100 is disposed within an aircraft 200, and the pressurized air source 104 may be a gas turbine engine 202.

Figure 2:
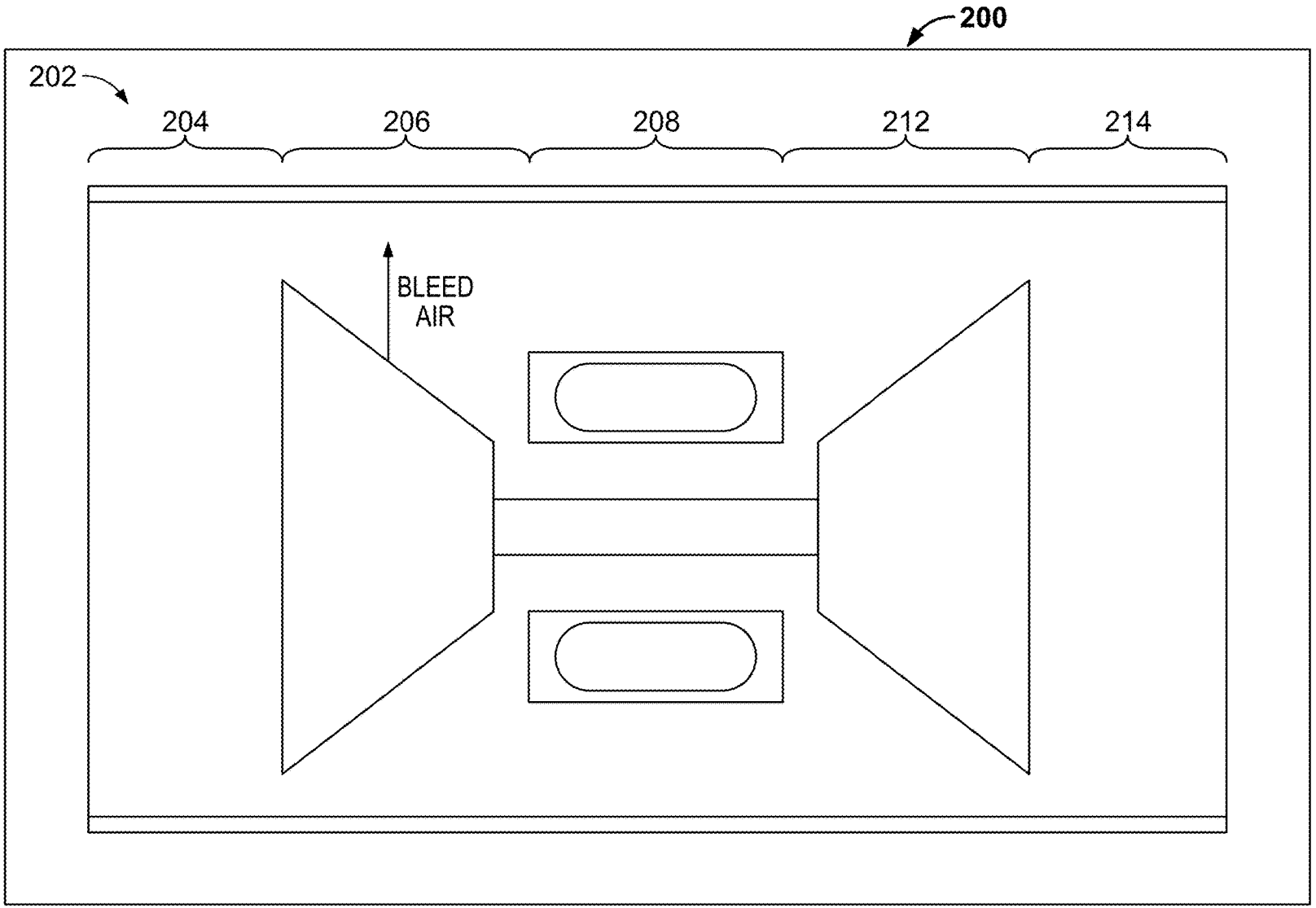
FIG. 2 depicts a simplified cross section view of one embodiment of a gas turbine engine on or in an aircraft and that may be used as the pressurized air source for the system in FIG. 1.

More specifically, at least in the embodiment depicted in FIG. 2, the gas turbine engine 202 includes an inlet section 204, a compressor section 206, a combustion section 208, a turbine section 212, and an exhaust section 214. As is generally known, during operation of the gas turbine engine 202, a portion of the air that is compressed in the compressor section 206 may be redirected to various pneumatic loads, such as the aerodynamic resonator 106. In such instances, the flow of pressurized air 112 is at least a portion of this redirected air, which is generally referred to as bleed air.

Returning now to FIG. 1, the aerodynamic resonator 106 includes an inlet nozzle 114, a resonance tube 116, and an outlet port 118. The aerodynamic resonator 106 is coupled to receive, via the inlet nozzle 114, the flow of pressurized air 112 at the first temperature and is configured to discharge, via the outlet port 118, the flow of pressurized air 112 at a second temperature, which is greater than the first temperature, into the at least one flow channel 108 of the component 102. To implement this functionality, and as is generally known, the resonance tube 116 includes an open end 122 and a closed end 124. The inlet nozzle 114 is configured to inject the flow of pressurized air 112 at the first temperature into the open end 122 of the resonance tube 116. The resonance tube 116 creates shock wave reflections at the closed end 124, thereby increasing the temperature and pressure of the pressurized air, via shock amplification. The flow of pressurized air 112 at the second temperature is then discharged out the outlet port 118 and into the at least one flow channel 108 of the component 102.

Figure 3:
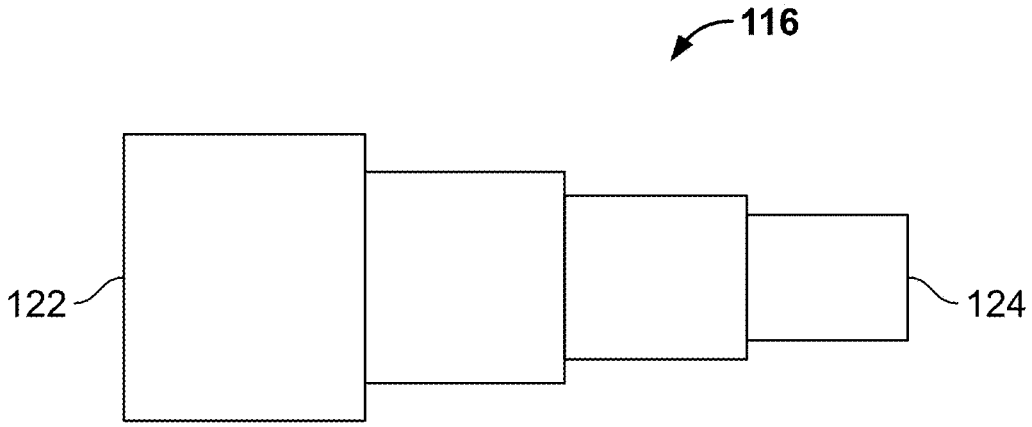
FIGS. 3 and 4 depict cross section views of different embodiments of a resonator tube that may be used with the aerodynamic resonator depicted in FIG. 1.
Figure 4:
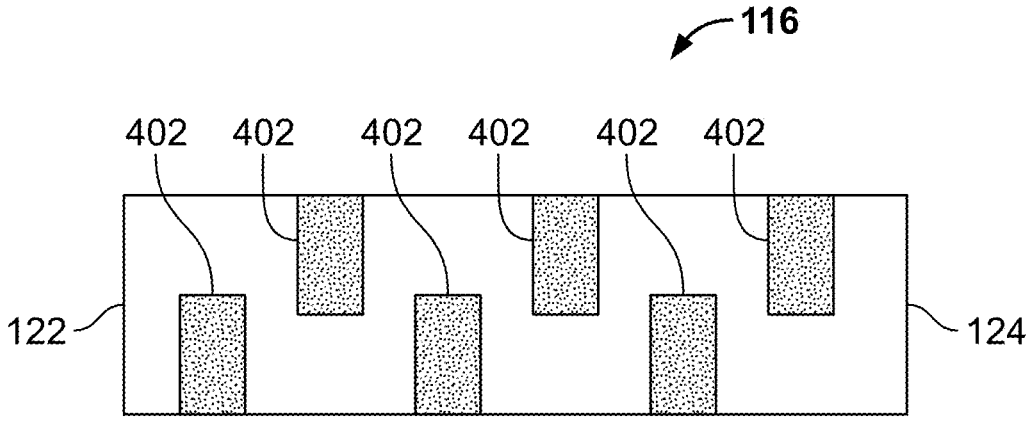

The shock amplification process implemented in the aerodynamic resonator 106 may depend, at least in part, on the geometrical configuration of the resonance tube 116. For example, in the embodiment depicted in FIG. 1, the resonance tube 116 is configured as a straight tube with a smooth inner surface. In other embodiments, the resonance tube 116 may be configured as a stepped tube, as depicted in FIG. 3, or as a staggered tube, having internal protuberances 402, as depicted in FIG. 4.

As is also generally known, the aerodynamic resonator 106 may be operated in three different modes. These modes are the jet instability mode, jet regurgitant, and jet screech modes. For each of the embodiments described herein, the configuration and operating conditions are such that the aerodynamic resonator 106 is operated in either the jet regurgitant mode or the jet screech mode.

Figure 5:
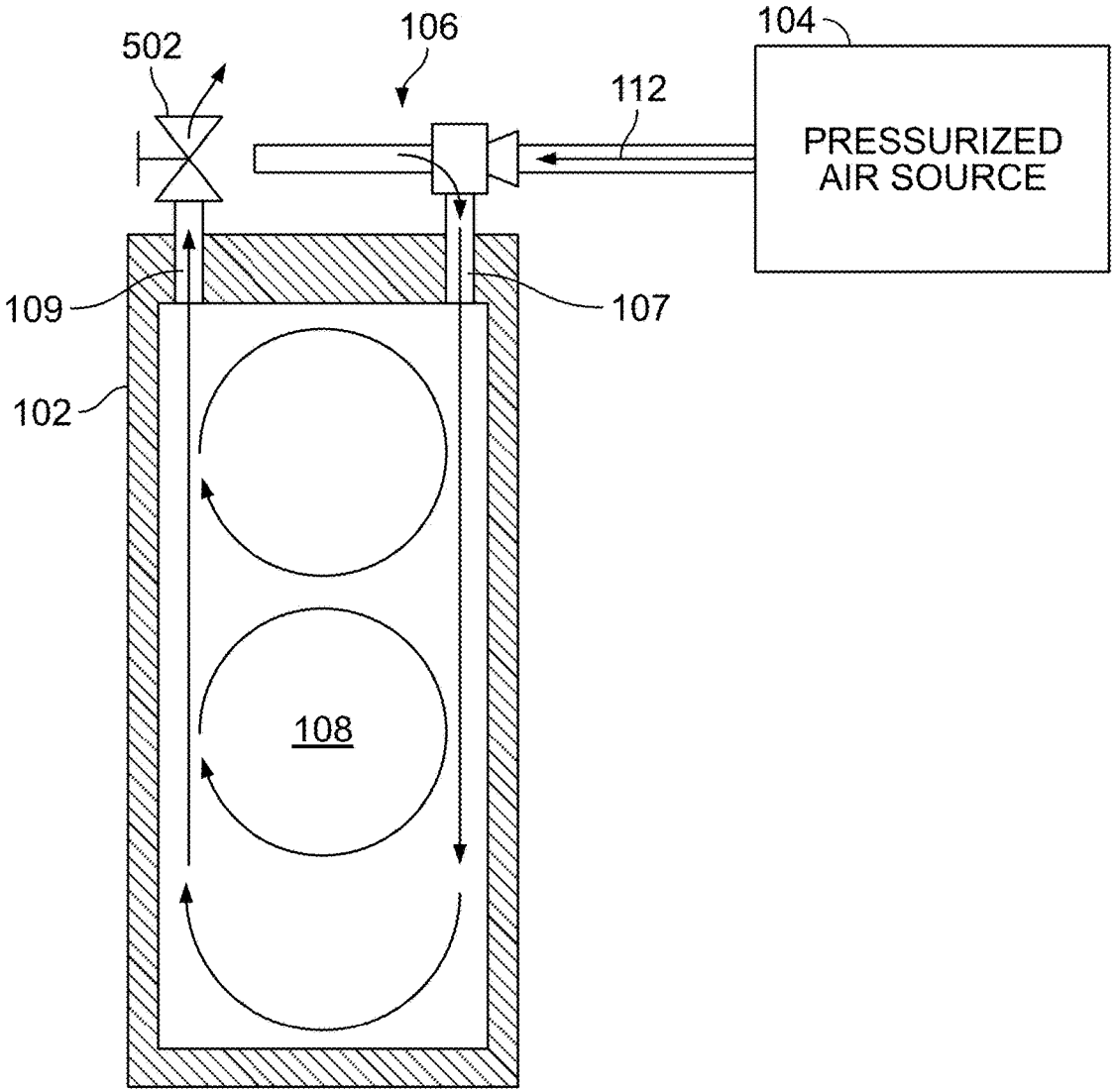
FIG. 5 depicts a simplified schematic representation of another example embodiment of an anti-ice/de-ice system.

Referring now to FIG. 5, it is seen that in some embodiments, the anti-ice/de-ice system 100 may additionally include a poppet valve 502. The poppet valve 502, when included, is disposed downstream of the flow channel outlet 109 and is moveable between a closed position and an open position. In the closed position, the flow of pressurized air 112 at the second temperature cannot flow through the at least one flow channel 108 and out the flow channel outlet 109. Conversely, in the open position, the flow of pressurized air 112 at a second temperature can flow through the at least one flow channel 108 and out the flow channel outlet 109.

Figure 6:
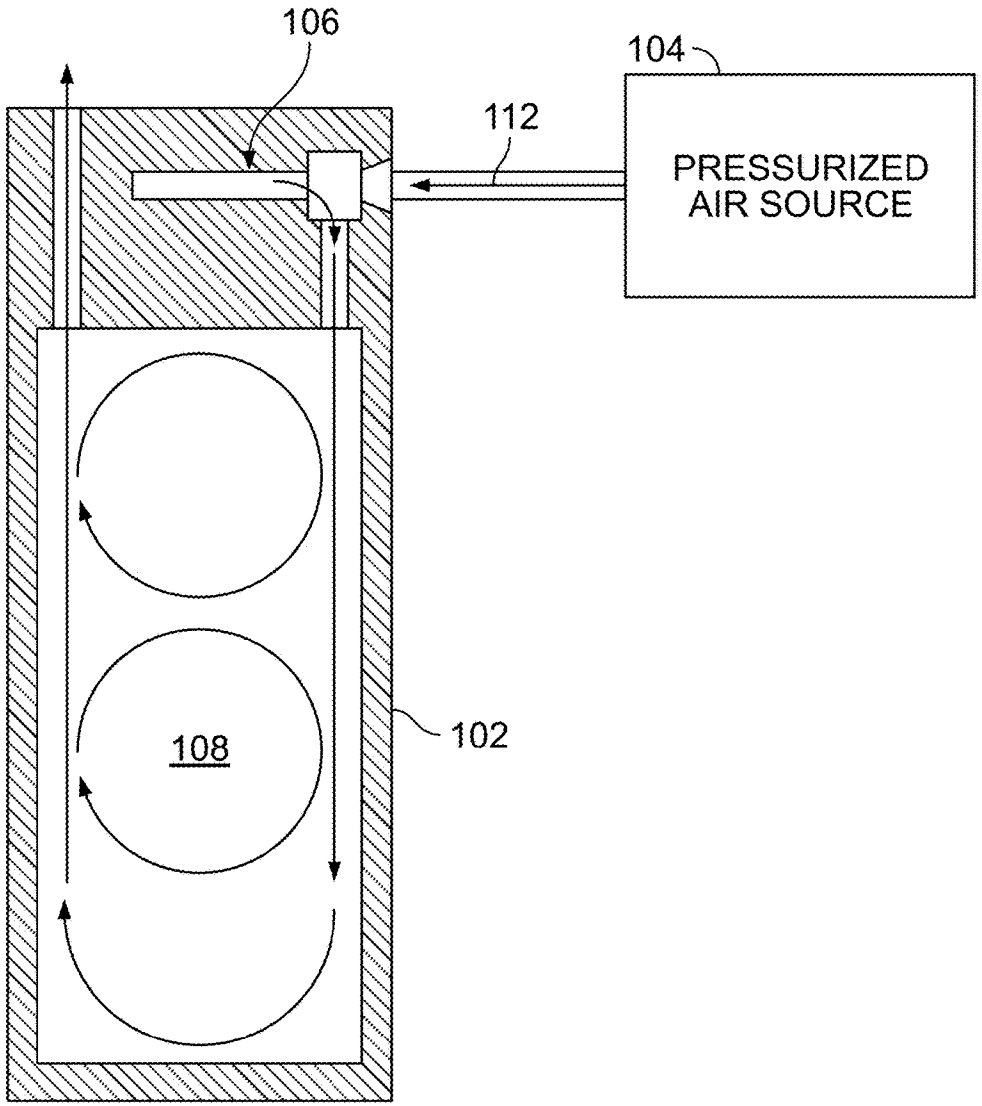
FIG. 6 depicts a simplified schematic representation of yet another example embodiment of an anti-ice/de-ice system.
Figure 7:
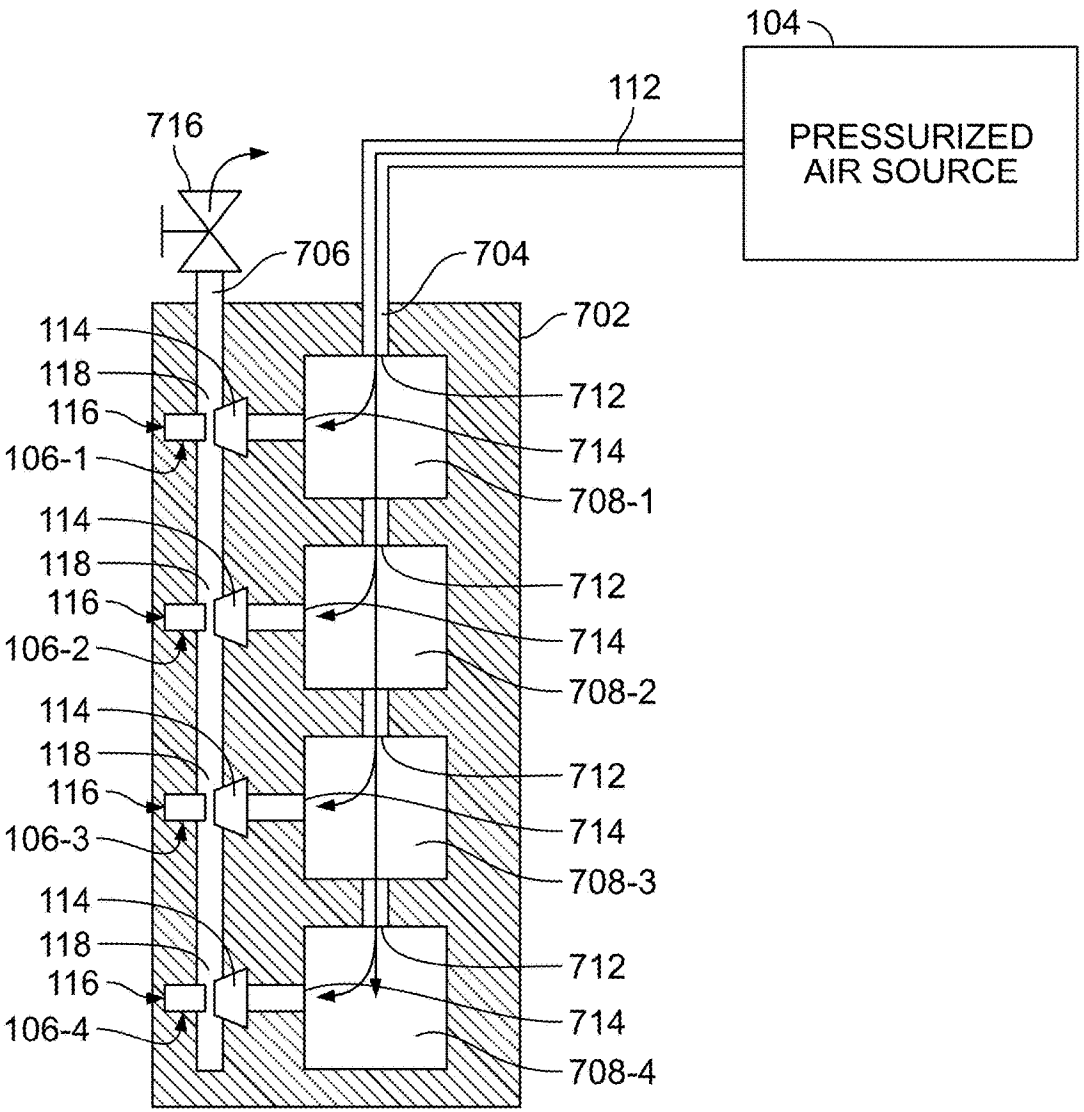
FIG. 7 depicts a simplified schematic representation of still another example embodiment of an anti-ice/de-ice system.

Thus far, the component 102 and the aerodynamic resonator 106 have been depicted and described as separate components. It will be appreciated, however, that in some embodiments, the aerodynamic resonator 106 may be formed integrally with the component 102. One such embodiment is depicted in FIG. 6, and another such embodiment is depicted in FIG. 7. The embodiment depicted in FIG. 7 includes a plurality of aerodynamic resonators 106 and, due to its unique configuration, will now be described in more detail.

As FIG. 7 depicts, the component 702 in this embodiment includes a pressurized air inlet 704, a pressurized air outlet 706. The component 702 additionally has a plurality of cavities 708 (708-1, 708-2, 708-3, 708-4) formed therein, and each cavity 708 has at least a cavity inlet port 712 and a cavity outlet port 714. It will be appreciated that although the component 702 depicted in FIG. 7 includes four cavities 708, the component 702, in other embodiments, could be implemented with more or less than this number of cavities 708.

No matter the specific number of cavities 708, a pressurized air source 104, such as those described above, is configured to supply the flow of pressurized air 112, at a first temperature, to each of the cavities 708, via the pressurized air inlet 704.

The aerodynamic resonators 106 are integrally formed within the component 702, and each aerodynamic resonator 106 is associated with a different one of the plurality of cavities 708. Thus, in the depicted embodiment, there are four aerodynamic resonators 106-106-1, 106-2, 106-3, 106-4. As with the previously described embodiments, each of the aerodynamic resonators 106 includes an inlet nozzle 114, a resonance tube 116, and an outlet port 118. In this embodiment, however, each inlet nozzle 114 is in fluid communication with the cavity outlet port 714 of its associated cavity 708, and each outlet port 118 is in fluid communication with the pressurized air outlet 706 of the component 702. As is also depicted, each aerodynamic resonator 106 is coupled to receive, via its inlet nozzle 114, the flow of pressurized air 112 at the first temperature from its associated cavity outlet port 714 and is configured to discharge, via its outlet port 118, the flow of pressurized air at the second temperature out the pressurized air outlet 706.

The embodiment depicted in FIG. 7 includes a valve 716. It will be appreciated, however, that it could be implemented without the valve 716. When included, the valve 716 is disposed downstream of, and is in fluid communication with, the pressurized air outlet 706. The valve 716 is moveable between a closed position, in which the flow of pressurized air at the second temperature cannot flow out of the pressurized air outlet 706, and an open position, in which the flow of pressurized air at the second temperature can flow out of the pressurized air outlet 706. It will be appreciated that the valve 716 may be implemented using a poppet valve, which may be actively controlled or automatically controlled via a non-illustrated control system, or a relief valve, which may be passively controlled.

The anti-ice/de-ice systems 100 described herein can reduce heated air mass flow rate from the pressurized air source 104, such as the extraction stage in the compressor section of a gas turbine engine 202, due to the lower inlet temperature requirements at certain pressure ratios. This can lead to improved aerodynamic efficiency of the gas turbine engine 202. The heating provided by the aerodynamic resonator 106 can also lead to higher enthalpy of the pressurized air 112 that is used to increase the temperature of the component 102, which can improve the cycle efficiency and lower the amount of heated air used for anti-icing/de-icing, which can also lead to an increase in the power output from the gas turbine engine 202.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An anti-ice/de-ice system, comprising:

a component having at least one flow channel extending therethrough;

a pressurized air source configured to supply a flow of pressurized air at a first temperature; and an aerodynamic resonator including an inlet nozzle, a resonance tube, and an outlet port, the aerodynamic resonator coupled to receive, via the inlet nozzle, the flow of pressurized air at the first temperature and configured to discharge, via the outlet port, the flow of pressurized air at a second temperature into the at least one flow channel of the component, wherein the second temperature is greater than the first temperature.

2. The system of claim 1, wherein:

the resonance tube includes an open end and a closed end;

the inlet nozzle is coupled to receive the flow of pressurized air at the first temperature and is configured to inject the flow of pressurized air into the open end of the resonance tube;

the resonance tube is configured to create shock wave reflections thereby increasing pressurized air temperature and pressure at the open end of the resonance tube; and the flow of pressurized air at the second temperature is discharged out the outlet port.

3. The system of claim 1, wherein the component comprises a static compressor blade.

4. The system of claim 1, wherein:

the component includes an inner surface and an outer surface; and the inner surface and the at least one flow channel together define an internal flow volume.

5. The system of claim 4, wherein the component comprises at least one static compressor blade.

6. The system of claim 4, wherein the component comprises an inlet portion of a gas turbine engine nacelle.

7. The system of claim 4, wherein the component comprises at least one aircraft control surface.

8. The system of claim 1, wherein the aerodynamic resonator is formed integrally with the component.

9. The system of claim 1, wherein the aerodynamic resonator is operated in one of a jet regurgitant mode or a jet screech mode.

10. The system of claim 1, wherein:

the at least one flow channel includes a flow channel inlet and a flow channel outlet; and the system further comprises a valve disposed downstream of the flow channel outlet, the valve moveable between a closed position, in which the flow of pressurized air at the second temperature cannot flow through the at least one flow channel and out the flow channel outlet, and an open position, in which the flow of pressurized air at the second temperature can flow through the at least one flow channel and out the flow channel outlet.

11. An aircraft anti-ice/de-ice system, comprising:

an aircraft component having at least one flow channel extending therethrough;

a pressurized air source disposed on or within the aircraft, the pressurized air source configured to supply a flow of pressurized air at a first temperature; and an aerodynamic resonator disposed on or within the aircraft, the aerodynamic resonator including an inlet nozzle, a resonance tube, and an outlet port, the aerodynamic resonator coupled to receive, via the inlet nozzle, the flow of pressurized air at the first temperature and configured to discharge, via the outlet port, the flow of pressurized air at a second temperature into the at least one flow channel of the component, wherein the second temperature is greater than the first temperature.

12. The system of claim 11, wherein:

the resonance tube includes an open end and a closed end;

the inlet nozzle is coupled to receive the flow of pressurized air at the first temperature and is configured to inject the flow of pressurized air into the open end of the resonance tube;

the resonance tube is configured to create shock wave reflections thereby increasing pressurized air temperature and pressure at the open end of the resonance tube; and the flow of pressurized air at the second temperature is discharged out the outlet port.

13. The system of claim 11, wherein the aircraft component comprises one or more of a static compressor blade, an inlet portion of a gas turbine engine nacelle, and an aircraft control surface.

14. The system of claim 11, wherein the aerodynamic resonator is formed integrally with the aircraft component.

15. The system of claim 11, wherein:

the at least one flow channel includes a flow channel inlet and a flow channel outlet; and the system further comprises a valve disposed downstream of the flow channel outlet, the valve moveable between a closed position, in which the flow of pressurized air at the second temperature cannot flow through the at least one flow channel and out the flow channel outlet, and an open position, in which the flow of pressurized air at the second temperature can flow through the at least one flow channel and out the flow channel outlet.

16. An anti-ice/de-ice system, comprising:

a component including a pressurized air inlet, a pressurized air outlet, and having a plurality of cavities formed therein, each cavity having at least a cavity inlet port and a cavity outlet port;

a pressurized air source configured to supply a flow of pressurized air at a first temperature to each of the cavities via the pressurized air inlet; and a plurality of aerodynamic resonators formed integrally with the component, each aerodynamic resonator associated with a different one of the plurality of cavities and including an inlet nozzle, a resonance tube, and an outlet port, each inlet nozzle in fluid communication with the cavity outlet port of its associated cavity, each outlet port in fluid communication with the pressurized air outlet, each aerodynamic resonator coupled to receive, via its inlet nozzle, the flow of pressurized air at the first temperature from its associated cavity outlet port and configured to discharge, via the outlet port, the flow of pressurized air at a second temperature out the pressurized air outlet, wherein the second temperature is greater than the first temperature.

17. The system of claim 16, further comprising:

a valve disposed downstream of, and in fluid communication with, the pressurized air outlet, the valve moveable between a closed position, in which the flow of pressurized air at the second temperature cannot flow out of the pressurized air outlet, and an open position, in which the flow of pressurized air at the second temperature can flow out of the pressurized air outlet.

18. The system of claim 16, wherein:

each resonance tube includes an open end and a closed end;

each inlet nozzle is coupled to receive the flow of pressurized air at the first temperature and is configured to inject the flow of pressurized air into the open end of the resonance tube;

each resonance tube is configured to create shock wave reflections thereby increasing pressurized air temperature and pressure at the open end of the resonance tube; and the flow of pressurized air at the second temperature is discharged out the outlet port.

19. The system of claim 16, wherein the aircraft component comprises one or more of a static compressor blade, an inlet portion of a gas turbine engine nacelle, and an aircraft control surface.

20. The system of claim 16, wherein the aerodynamic resonator is formed integrally with the aircraft component.

* * * * *